US012460333B2

(12) United States Patent
Imaizumi

(10) Patent No.: US 12,460,333 B2
(45) Date of Patent: Nov. 4, 2025

(54) CONTROL DEVICE FOR SEWING MACHINE, AND SEWING MACHINE

(71) Applicant: BROTHER KOGYO KABUSHIKI KAISHA, Nagoya (JP)

(72) Inventor: Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/796,872

(22) Filed: Aug. 7, 2024

(65) Prior Publication Data

US 2024/0392484 A1 Nov. 28, 2024

Related U.S. Application Data

(63) Continuation of application No. PCT/JP2023/003546, filed on Feb. 3, 2023.

(30) Foreign Application Priority Data

Feb. 10, 2022 (JP) ..... 2022-019332

(51) Int. Cl.
*D05B 19/12* (2006.01)
*D05B 81/00* (2006.01)

(52) U.S. Cl.
CPC ..... *D05B 19/12* (2013.01); *D05B 81/00* (2013.01)

(58) Field of Classification Search
CPC ..... D05B 19/006; D05B 19/08; D05B 19/06; D05B 19/10; D05B 19/12
See application file for complete search history.

(56) References Cited

U.S. PATENT DOCUMENTS 8,061,286 B2 * 11/2011 Hirata ..... D05B 19/10 112/102.5
11,401,641 B2 * 8/2022 Oka ..... D05B 79/00
(Continued)

FOREIGN PATENT DOCUMENTS

JP 2009-172123 A 8/2009
JP 2009-297190 A 12/2009
(Continued)

OTHER PUBLICATIONS

Aug. 6, 2024, International Preliminary Report on Patentability issued in International Patent Application No. PCT/JP2023/003546.
(Continued)

*Primary Examiner* — Danny Worrell
(74) *Attorney, Agent, or Firm* — Oliff PLC

(57) ABSTRACT

A controller of a control device for a sewing machine changes a capture control state of an image sensor between a capture execution state of controlling the image sensor to perform image capturing and a capture non-execution state of controlling the image sensor to not perform image capturing, changes a projection control state of a projector between a projection execution state of controlling the projector to perform projection of a projection image and a projection non-execution state of controlling the projector to not perform projection of the projection image, and in a case where the projection control state is in the projection execution state and the capture control state changes from the capture non-execution state to the capture execution state, changes the projection control state from the projection execution state to the projection non-execution state.

20 Claims, 9 Drawing Sheets

(56) References Cited

U.S. PATENT DOCUMENTS

| | | | | |
|---|---|---|---|---|
| 11,891,739 | B2 * | 2/2024 | Kamihira | D05B 19/12 |
| 2008/0065549 | A1 * | 3/2008 | Hirata | G06Q 90/00<br>705/51 |
| 2009/0188413 | A1 | 7/2009 | Hirata et al. | |
| 2009/0312861 | A1 | 12/2009 | Hirose et al. | |
| 2010/0139538 | A1 * | 6/2010 | Tashiro | D05B 19/10<br>112/102.5 |
| 2011/0226170 | A1 | 9/2011 | Tokura | |
| 2012/0048163 | A1 | 3/2012 | Tokura | |
| 2020/0048807 | A1 | 2/2020 | Imaizumi | |
| 2020/0314081 | A1 | 10/2020 | Yamamoto et al. | |

FOREIGN PATENT DOCUMENTS

| | | | |
|---|---|---|---|
| JP | 2011-194043 | A | 10/2011 |
| JP | 2012-045019 | A | 3/2012 |
| JP | 2020-025604 | A | 2/2020 |
| JP | 2020-092855 | A | 6/2020 |
| JP | 2020-156822 | A | 10/2020 |

OTHER PUBLICATIONS

Apr. 11, 2023 International Search Report issued in International Patent Application No. PCT/JP2023/003546.

* cited by examiner

CONTROL DEVICE FOR SEWING MACHINE, AND SEWING MACHINE

REFERENCE TO RELATED APPLICATIONS

This is a Continuation Application of International Application No. PCT/JP2023/003546 filed on Feb. 3, 2023, which claims priority from Japanese Patent Application No. 2022-019332 filed on Feb. 10, 2022. The entire content of each of the prior applications is incorporated herein by reference.

BACKGROUND ART

A sewing machine that sews a sewing pattern on a sewing workpiece set on a bed is conventionally known.

SUMMARY

For example, a sewing machine includes an image sensor that captures an image on a sewing workpiece and a projector that projects a projection image toward a bed, and creates an image of a sewing pattern and so on as a projection image based on an image captured by the image sensor. For example, a sewing machine controls sewing based on an image captured by an image capturing unit. For example, a sewing machine captures an image of a marker on a sewing workpiece by an image sensor and determines an arrangement of a pattern to be sewn.

In the above-mentioned sewing machines, a new technique is conceivable in which an image of a marker on a sewing workpiece is captured, a projection image representing an arrangement of a sewing pattern is created based on the captured image of the marker, and the projection image is projected toward the bed. In a case where the new technology is employed in a sewing machine, when the projection image is projected onto the sewing workpiece at the time of capturing an image of the marker on the sewing workpiece after the position of the marker is changed, there is a possibility that the image of the marker may not be accurately captured due to an influence of the projection image, and the sewing may not be accurately controlled.

In view of the foregoing, an example of an object of this disclosure is to provide a controller for a sewing machine including a projector and an image sensor, the controller being configured to automatically change the projector from a projection execution state to a projection non-execution state in a case where the image sensor is changed from a capture non-execution state to a capture execution state.

According to one aspect, this specification discloses a control device for a sewing machine including a bed, an image sensor configured to capture an image on the bed, and a projector configured to project a projection image toward the bed. The control device includes a controller. The controller is configured to change a capture control state of the image sensor between a capture execution state of controlling the image sensor to perform image capturing and a capture non-execution state of controlling the image sensor to not perform image capturing. Thus, the control device changes the capture control state between the capture execution state and the capture non-execution state. The controller is configured to change a projection control state of the projector between a projection execution state of controlling the projector to perform projection of the projection image and a projection non-execution state of controlling the projector to not perform projection of the projection image. Thus, the control device changes the projection control state between the projection execution state and the projection non-execution state. The controller is configured to, in a case where the projection control state is in the projection execution state and the capture control state changes from the capture non-execution state to the capture execution state, change the projection control state from the projection execution state to the projection non-execution state. Thus, the control device changes the projection control state from the projection execution state to the projection non-execution state in a case where the capture control state changes from the capture non-execution state to the capture execution state. Thus, the projection and the image capturing are not performed at the same time, the influence of the projection image on the captured image is reduced, and the control device for the sewing machine accurately controls the sewing.

According to another aspect, a controller of a control device for a sewing machine is configured to, in a case where the capture control state is in the capture execution state and the projection control state changes from the projection non-execution state to the projection execution state, change the capture control state from the capture execution state to the capture non-execution state. Thus, the control device changes the capture control state from the capture execution state to the capture non-execution state in a case where the projection control state changes from the projection non-execution state to the projection execution state.

According to still another aspect, this specification also discloses a sewing machine. The sewing machine includes a bed, an image sensor configured to capture an image on the bed, a projector configured to project a projection image toward the bed, and the above-described controller. Thus, the controller of the sewing machine changes the projection control state from the projection execution state to the projection non-execution state in a case where the capture control state changes from the capture non-execution state to the capture execution state.

DESCRIPTION

Figure 1:
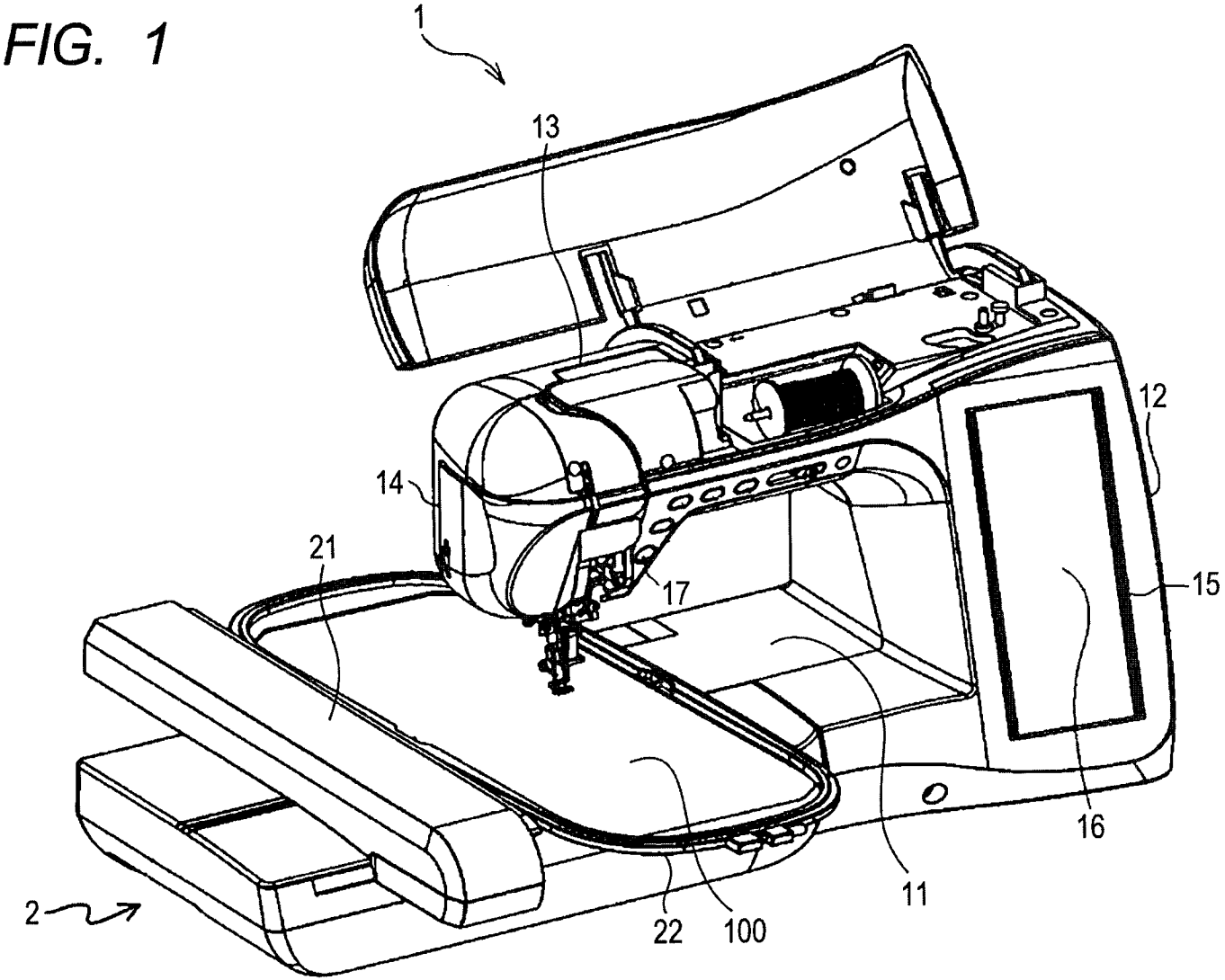
FIG. 1 is a perspective view of a sewing machine 1 to which an embroidery device 2 is attached.

Hereinafter, embodiments of the present disclosure will be described with reference to the drawings. It should be noted that these drawings are used to describe the technical features of the present disclosure, and the configuration and so on of the described device are merely illustrative examples. Hereinafter, directions used in the description are based on the directions described in the respective drawings.

A first embodiment of the present disclosure will be described. A mechanical configuration of a sewing machine 1 will be described with reference to FIG. 1. The sewing machine 1 includes a bed 11, a column (pillar) 12, an arm 13, and a head 14. The bed 11 is a base portion of the sewing machine 1. The column 12 is erected upward from an end of the bed 11. The arm 13 extends from an upper end of the column 12 so as to face the bed 11. The head 14 is a portion connected to an end of the arm 13.

A rectangular display 15 is provided on a front surface of the column 12. The display 15 displays an image including various items such as a command, an illustration, a setting value, and a message text. A touch panel 16 configured to detect an operated position is provided on the front side of the display 15. When a user operates the touch panel 16 with a finger or a dedicated touch pen, the operated position is detected, and an item in the image is selected. By operating the touch panel 16, the user performs processing such as selecting and editing a pattern that the user wishes to sew.

Various switches including a sewing switch 17 are provided on a lower portion of a front surface of the arm 13. The sewing switch 17 is used to start or stop an operation of the sewing machine 1, that is, to input an instruction to start or stop sewing.

The sewing machine 1 in FIG. 1 is in a state in which an embroidery device 2 is attached. The embroidery device 2 includes a carriage (not shown), a carriage cover 21, a front-rear movement mechanism (not shown), a left-right movement mechanism (not shown), and an embroidery frame 22. The carriage detachably holds the embroidery frame 22. The carriage cover 21 has a rectangular parallelepiped shape and accommodates the carriage. The front-rear movement mechanism is provided inside the carriage cover 21, and the left-right movement mechanism is provided inside the embroidery device 2. The embroidery frame 22 is moved in the front-rear direction and the left-right direction by the front-rear movement mechanism and the left-right movement mechanism.

Figure 2:
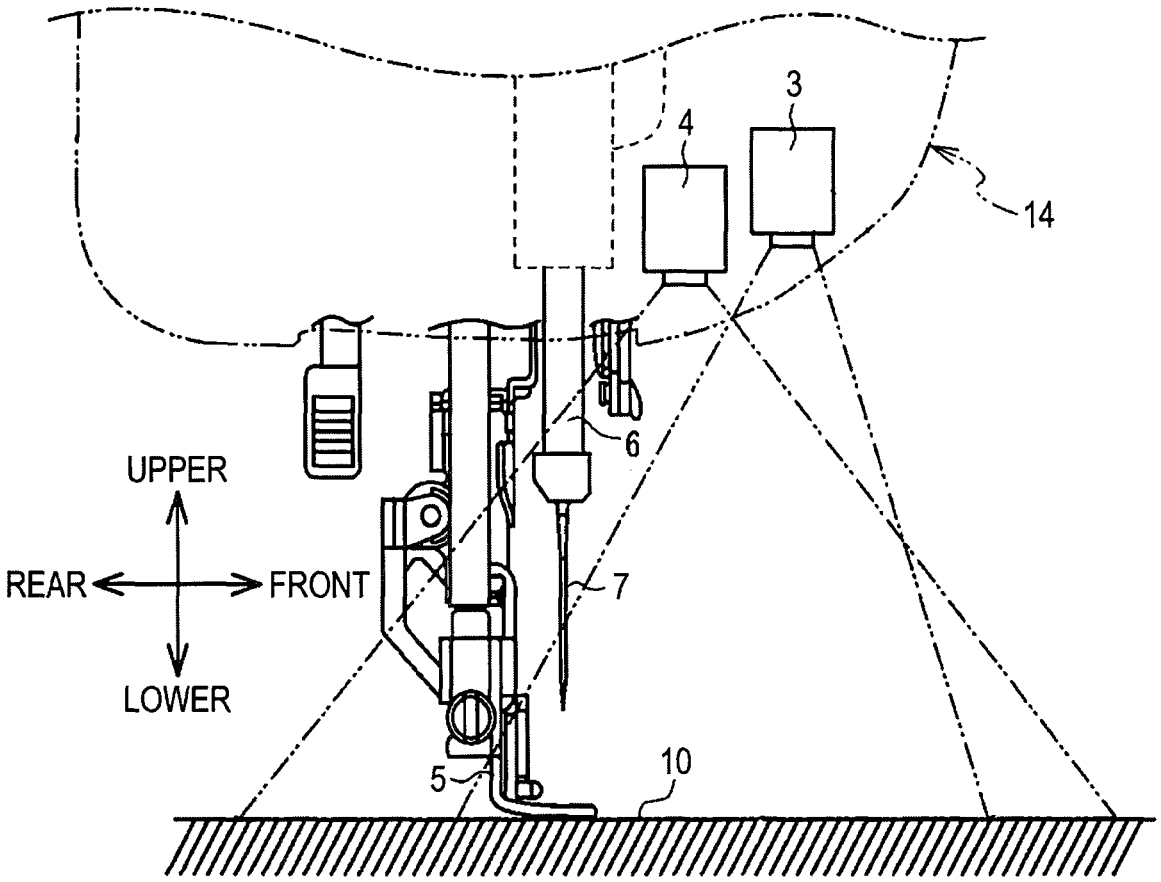
FIG. 2 is a side view of a portion below a head 14.

The mechanical configuration of the head 14 will be described with reference to FIG. 2. The head 14 includes a needle bar 6, a presser bar, an image capturing unit 4, and a projector 3. A sewing needle 7 is detachably attached to the lower end of the needle bar 6. A presser foot 5 is detachably attached to the lower end of the presser bar. The needle bar 6 is driven in the upper-lower direction by rotation of a main drive shaft. At the time of sewing, the sewing machine 1 of FIG. 1 moves the sewing needle 7 attached to the needle bar 6 up and down with respect to a sewing workpiece 10 that is set on the embroidery frame 22 that is moved in the front-rear and left-right directions, thereby forming stitches.

The image capturing unit 4 (for example, a camera) includes an image sensor 42, and captures an image of an image capturing region in a particular range on the bed 11.

The projector 3 is configured to project an image onto a projection region defined at a particular position on the bed 11 (the sewing workpiece 10). The projector 3 includes a cylindrical housing, and a liquid crystal panel 34, a light source 32, and a projection optical system 35 which are accommodated in the housing. The housing is fixed to a machine frame in the head 14. The light source 32 is an LED, for example. The liquid crystal panel 34 modulates light from the light source 32 and forms image light of a projection image. The projection optical system 35 is, for example, an imaging lens, and forms an image of image light formed by the liquid crystal panel 34 in a projection region on the bed 11. The projection region and the image capturing region share a part of each region on the bed 11.

Figure 3:
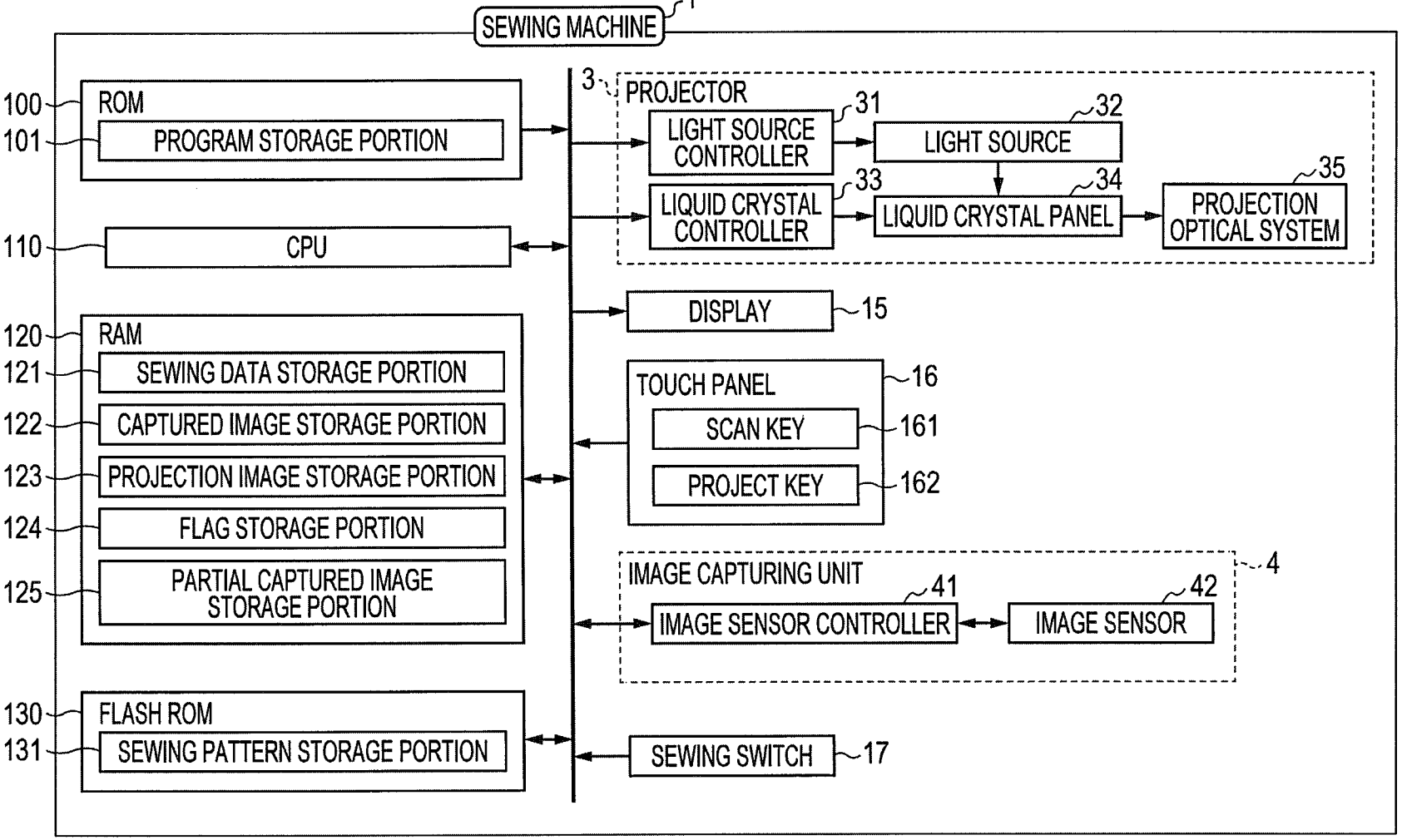
FIG. 3 is a block diagram showing an electrical configuration of the sewing machine 1.

An electrical configuration of the sewing machine I will be described with reference to FIG. 3. The sewing machine 1 includes a ROM 100, a CPU 110, a RAM 120, and a flash ROM 130 as a sewing machine controller. In the electrical configuration of the sewing machine 1, an electrical configuration that controls the operation of a stitch forming mechanism that performs needle bar swinging, feed adjustment, and so on is well known from Japanese Patent Application Publication No. 2009-172123 (corresponding to U.S. Patent Application Publication No. 2009/0188413) and so on, and thus description and illustration of the configuration are omitted.

The ROM 100 stores a boot program, a BIOS, and so on, and includes a program storage portion 101. The program storage portion 101 stores a program for the CPU 110 to control the sewing machine 1. The RAM 120 includes a sewing data storage portion 121, a captured image storage portion 122, a projection image storage portion 123, a flag storage portion 124, and a partial captured image storage portion 125. The captured image storage portion 122 stores a captured image showing the entire image capturing region. The flag storage portion 124 stores a projection flag indicating whether projection is being performed and an image capturing flag indicating whether image capturing is being performed. For example, when the projection flag is stored as "0", it indicates that the projection is not being performed, and when the projection flag is stored as "1", it indicates that the projection is being performed. The partial captured image storage portion 125 stores an image indicating a part of the image capturing region. The flash ROM 130 includes a sewing pattern storage portion 131. The sewing pattern storage portion 131 stores sewing data for sewing a sewing pattern and a sewing pattern image indicating the sewing pattern.

Further, the projector 3, the display 15, the touch panel 16, the image capturing unit 4, and the sewing switch 17 are electrically connected to the sewing machine controller.

The projector 3 includes a light source controller 31, the light source 32, a liquid crystal controller 33, a liquid crystal panel 34, and the projection optical system 35. The light source controller 31 controls the amount of light emitted by the light source 32. The liquid crystal controller 33 controls a transmittance of each of the red, green, and blue liquid crystal elements (not shown) in the liquid crystal panel 34 based on the input image.

The front surface of the display 15 is configured by the touch panel 16. The user operates the touch panel 16 with his or her finger or a touch pen. The touch panel 16 has functions as a scan key 161 and a project key 162. The user starts image capturing at a desired timing by operating the scan key 161. The user starts or ends projection at a desired timing by operating the project key 162.

The image capturing unit 4 includes an image sensor controller 41 and the image sensor 42. In response to receiving a signal for starting image capturing, the image sensor controller 41 controls the image sensor 42 to sequentially capture a part of the image capturing region, and continues image capturing until image capturing of the entire image capturing region is finished.

Figure 4:
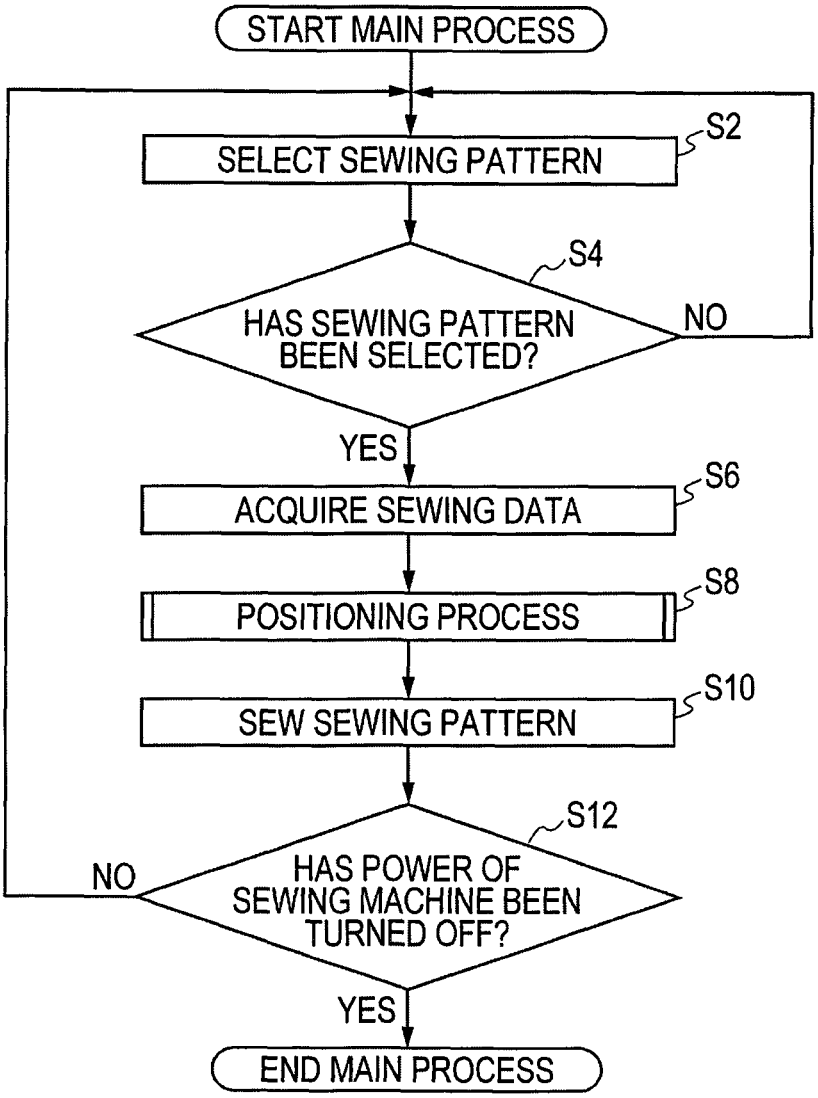
FIG. 4 is a flowchart showing a main process of the sewing machine 1.

An operation of a main process performed by the sewing machine 1 will be described with reference to a flowchart shown in FIG. 4. When the user turns on a power switch of the sewing machine 1, the CPU 110 executes programs stored in the program storage portion 101 to start the main process. Each processing of a series of processing in S2 to S12 shown in FIG. 4 is performed by the CPU 110 of the sewing machine 1.

The CPU 110 displays a plurality of types of sewing pattern images stored in the sewing pattern storage portion 131 of the flash ROM 130, on the display 15. The user operates the touch panel 16, and selects the sewing pattern image representing a desired sewing pattern from the sewing pattern images displayed on the display 15 (S2).

The CPU 110 determines whether the sewing pattern has been selected (S4). In a case where the sewing pattern has been selected (S4: YES), the CPU 110 advances the processing to S6. In a case where no sewing pattern has been selected (S4: NO), the CPU 110 returns the processing to S2, and displays the plurality of types of sewing pattern images on the display 15 again to allow the user to select the sewing pattern.

The CPU 110 reads out and acquires sewing data for the selected sewing pattern from the sewing pattern storage portion 131 of the flash ROM 130 (S6). The sewing data includes needle drop coordinate data and thread color data necessary for sewing the sewing pattern. The acquired sewing data is stored in the sewing data storage portion 121 of the RAM 120.

The CPU 110 performs a positioning process described later (S8).

The CPU 110 controls operations of the stitch forming mechanism of the sewing machine 1 such as a sewing machine motor and a needle bar swinging mechanism, and the embroidery device 2 so as to sew the sewing pattern on the sewing workpiece 10 (S10). The sewing is performed by vertically moving the sewing needle 7 attached to the needle bar 6 relative to the sewing workpiece 10 held by the embroidery frame 22 moved in front-rear and left-right directions to form stitches.

After the sewing of the sewing pattern is completed, the CPU 110 determines whether the sewing machine 1 has been turned off by a turn-off operation of the power switch of the sewing machine 1 by the user (S12). In a case where the sewing machine 1 has been turned off (S12: YES), the CPU 110 ends the main process. In a case where the sewing machine 1 has not been turned off (S12: NO), the CPU 110 returns the processing to S2, and performs the processing in S2 to S10 again.

Figure 5:
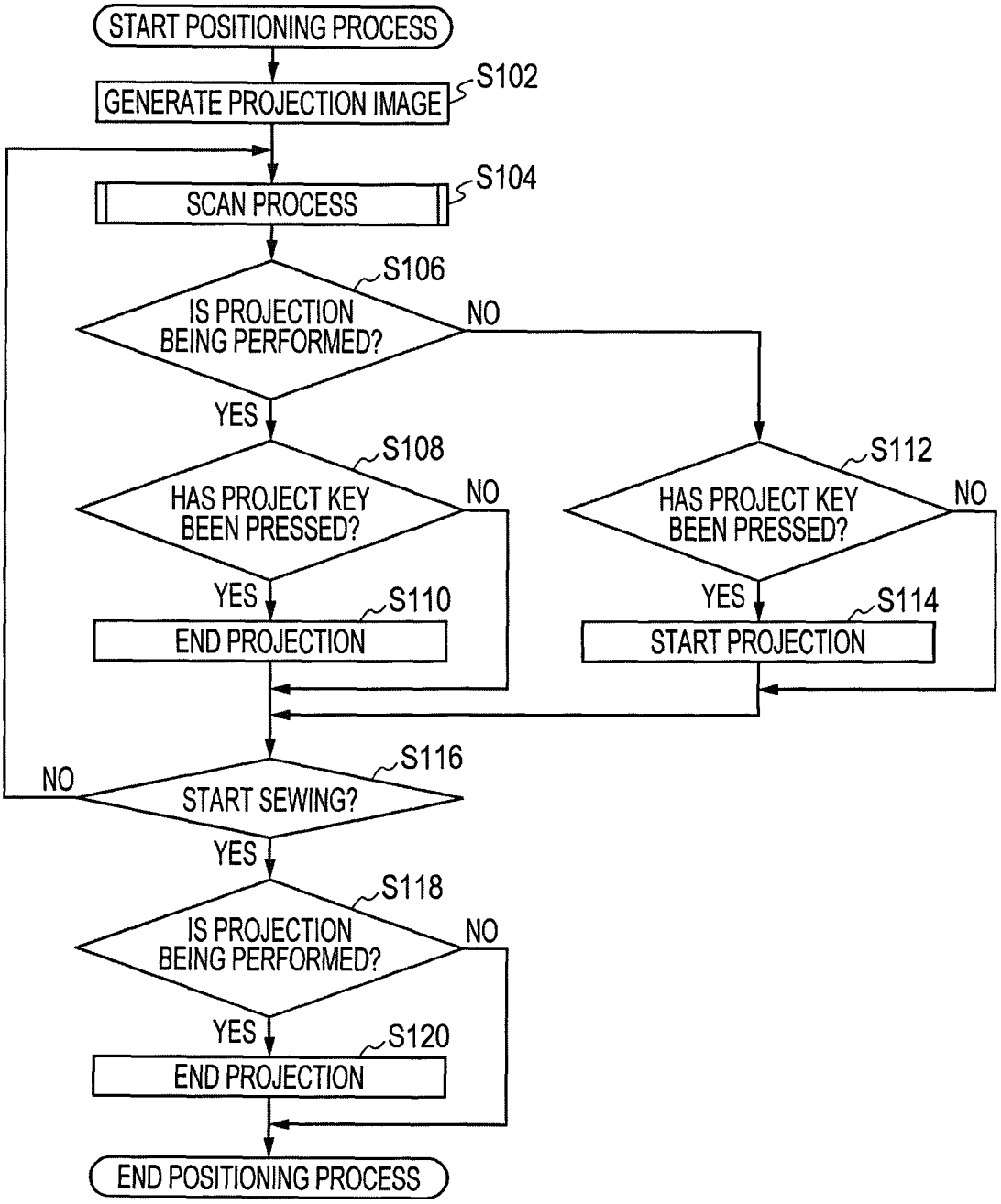
FIG. 5 is a flowchart showing a positioning process of the sewing machine 1.

An operation of the positioning process performed by the sewing machine 1 according to the first embodiment will be described with reference to a flowchart shown in FIG. 5. Each processing of a series of processing in S102 to S120 shown in FIG. 5 is performed by the CPU 110 of the sewing machine 1.

The CPU 110 generates a projection image representing the sewing pattern (S102). The projection image is generated based on the sewing data stored in the sewing data storage portion 121. The sewing pattern in the projection image is disposed at a particular initial position. The initial position is, for example, a center position of the projection image. The generated projection image is stored in the projection image storage portion 123 of the RAM 120.

The CPU 110 performs a scan process described later (S104).

The CPU 110 determines whether projection by the projector 3 is being performed (S106). The CPU 110 determines whether the projection is being performed, based on the projection flag stored in the flag storage portion 124 of the RAM 120. In a case where the projection flag "0" is stored, the projection is not being performed, whereas in a case where the projection flag "1" is stored, the projection is being performed. The projection flag is stored as an initial value "0". In a case where the projection is being performed (S106: YES), the CPU 110 advances the processing to S108. In a case where the projection is not being performed (S106: NO), the CPU advances the processing to S112.

In a case where the projection is being performed (S106: YES), the CPU 110 determines whether the project key 162 has been pressed (S108). The project key 162 is set in a particular region of the touch panel 16 on a surface of the display 15. In a case where the user presses the project key 162 by a finger and so on, the CPU 110 receives a signal indicating pressing of the project key 162, and determines that the project key 162 has been pressed (S108: YES). In a case where the project key 162 has been pressed (S108: YES), the CPU 110 advances the processing to S110. In a case where the project key 162 has not been pressed (S108: NO), the CPU 110 advances the processing to S116.

In a case where the projection is being performed (S106: YES) and the project key has been pressed (S108: YES), the projection is ended (S110). In a case where the projection is being performed (S106: YES) and the project key 162 has been pressed (S108: YES), the CPU 110 transmits a signal indicating end of the projection to the light source controller 31 and the liquid crystal controller 33 of the projector 3. In response to receiving the signal indicating end of the projection, the light source controller 31 stops power supply to the light source 32. In response to receiving the signal indicating end of the projection, the liquid crystal controller 33 initializes the transmittance of each of the liquid crystal elements of the liquid crystal panel 34. Initialization of the transmittance of each of the liquid crystal elements of the liquid crystal panel 34 means, for example, setting of the transmittance to "0". By stopping the power supply to the light source 32 and initializing the transmittance of each of the liquid crystal elements of the liquid crystal panel 34, the projection by the projector 3 is ended. After the projection is ended, the CPU 110 sets the projection flag stored in the flag storage portion 124 to "0" in S110.

In a case where the projection is not being performed (S106: NO), the CPU 110 determines whether the project key 162 has been pressed (S112). The determination of whether the project key 162 has been pressed is performed by processing similar to processing in S108. In a case where the project key has been pressed (S112: YES), the CPU 110 advances the processing to S114. In a case where the project key 162 has not been pressed (S112: NO), the CPU 110 advances the processing to S116.

In a case where the projection is not being performed (S106: NO) and the project key 162 has been pressed (S112: YES), projection is started (S114). In a case where the projection is not being performed (S106: NO) and the project key 162 has been pressed (S112: YES), the CPU 110 transmits a signal indicating start of the projection to the light source controller 31, reads out the projection image stored in the projection image storage portion 123, and transmits the projection image to the liquid crystal controller 33. In response to receiving the signal indicating start of the projection, the light source controller 31 starts power supply to the light source 32. In response to receiving the projection image, the liquid crystal controller 33 sets the transmittance of each of the liquid crystal elements of the liquid crystal panel 34 based on the projection image. In a case where power is supplied to the light source 32, and light is applied to each of the liquid crystal elements of the liquid crystal panel 34 set to the transmittance based on the projection image, projection of the projection image is started. After the projection is started, the CPU 110 sets the projection flag stored in the flag storage portion 124 to "1" in S114.

The CPU 110 determines whether to start sewing (S116). To start sewing, the user presses the sewing switch 17 of the sewing machine 1. In a case where the sewing switch 17 has been pressed, the CPU 110 receives a signal indicating start of sewing, and determines to start sewing (S116: YES). In a case where the sewing switch 17 has not been pressed, the CPU 110 determines not to start sewing (S116: NO). In a case where it is determined to start sewing (S116: YES), the CPU 110 advances the processing to S118. In a case where it is determined not to start sewing (S116: NO), the CPU 110 returns the processing to S104, and performs the scan process again.

The CPU 110 determines whether the projection by the projector 3 is being performed (S118). The determination of whether the projection is being performed is performed by processing similar to S106. In a case where the projection is being performed (S118: YES), the CPU 110 advances the processing to S120. In a case where the projection is not being performed (S118: NO), the CPU 110 ends the positioning process.

In a case where the projection is being performed (S118: YES), the projection is ended (S120). The projection is ended by processing similar to S110. After the projection is ended, the CPU 110 ends the positioning process.

Figure 6:
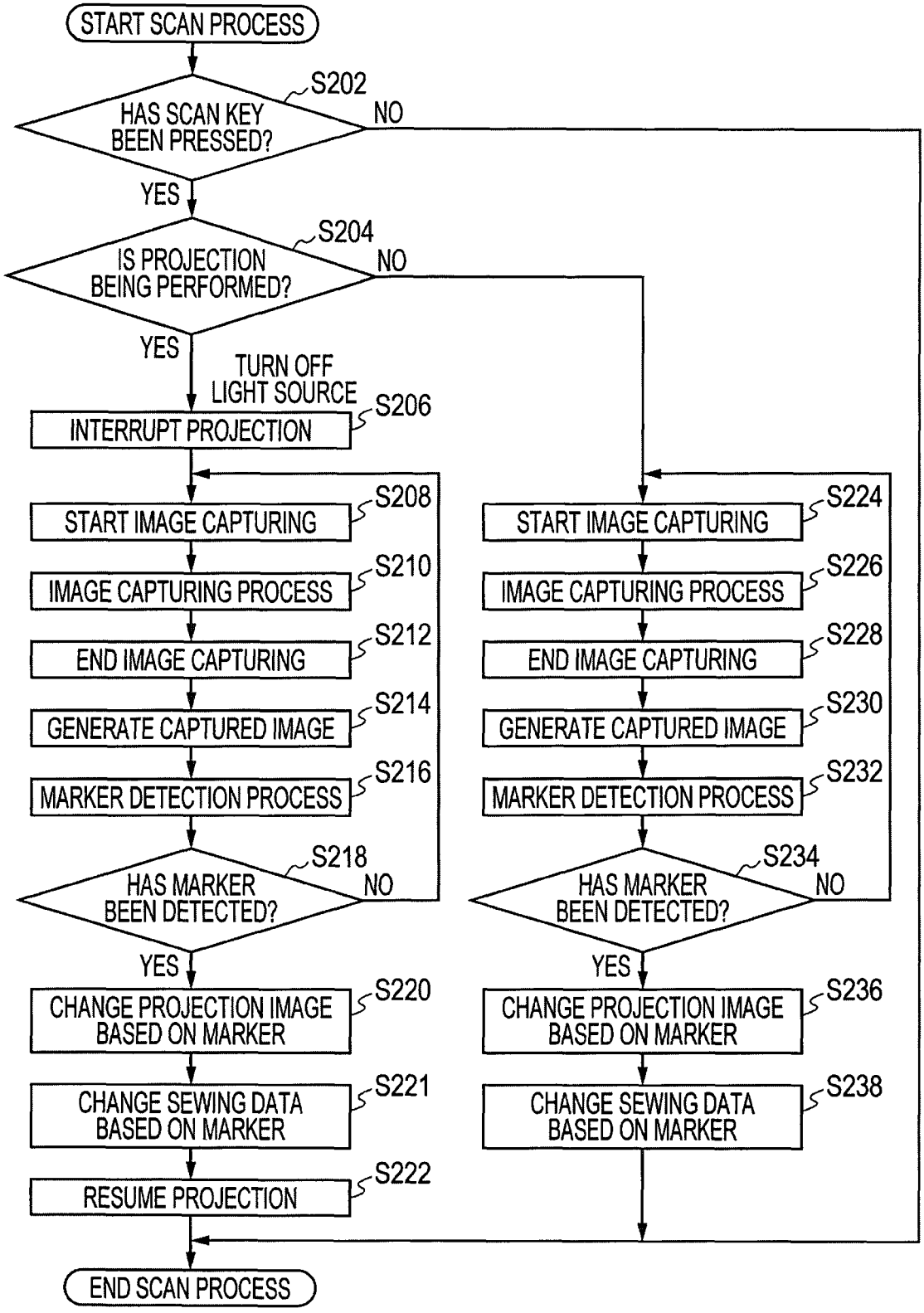
FIG. 6 is a flowchart showing a scan process of the sewing machine 1.

An operation of the scan process performed by the sewing machine 1 according to the first embodiment will be described with reference to a flowchart shown in FIG. 6. Each of processing of a series of processing in S202 to S238 shown in FIG. 6 is performed by the CPU 110 of the sewing machine 1.

In the first embodiment, to set a formation position of the sewing pattern on the sewing workpiece, the user affixes a marker to a position on the sewing workpiece corresponding to the formation position. In a case where the user first affixes the marker before sewing, it is necessary for the user to press the scan key 161 to capture the marker first affixed in order to set the formation position of the sewing pattern corresponding to the position where the marker is first affixed. In a case where the user changes the position of the marker from the position where the marker is first affixed to a new position, it is necessary for the user to press the scan key 161 to capture the marker affixed to a new affixing position in order to set a new formation position of the sewing pattern corresponding to the new affixing position.

The CPU 110 determines whether the scan key 161 has been pressed in order to capture the marker affixed to the new affixing position (S202). The scan key 161 is set in a particular region of the touch panel 16 on the surface of the display 15. When the user presses the scan key 161 by a finger and so on, the CPU 110 receives a signal indicating pressing of the scan key 161, and determines that the scan key 161 has been pressed (S202:YES). In a case where the scan key 161 has been pressed (S202:YES), the CPU 110 advances the processing to S204. In a case where the scan key 161 has not been pressed (S202:NO), the CPU 110 ends the scan process.

The CPU 110 determines whether the projection by the projector 3 is being performed (S204). The determination of whether the projection is being performed is performed by processing similar to S106. In a case where the projection is being performed (S204:YES), the CPU 110 advances the processing to S206. In a case where the projection is not being performed (S204:NO), the CPU 110 advances the processing to S224.

In a case where the projection is being performed (S204: YES), the CPU 110 interrupts the projection (S206). A projection interruption process is performed by, for example, transmitting a signal indicating interruption of the projection to the light source controller 31 of the projector 3. In response to receiving the signal indicating interruption of the projection, the light source controller 31 stops power supply to the light source 32. When the power supply to the light source 32 is stopped, irradiation of light from the light source 32 is stopped, and the projection by the projector 3 is interrupted. After the projection is interrupted, the CPU 110 sets the projection flag stored in the flag storage portion 124 to "0" in S206.

The CPU 110 transmits a signal indicating start of image capturing to the image sensor controller 41 of the image capturing unit 4, to start image capturing (S208). In response to receiving the signal indicating start of image capturing, the image sensor controller 41 starts power supply to the image sensor 42. By supplying power to the image sensor 42, the image capturing unit 4 becomes a state where the image capturing unit 4 is ready to perform an image capturing process. In S208, the CPU 110 sets the image capturing flag stored in the flag storage portion 124 to "1". In a case where the image capturing flag "0" is stored, the image capturing is not being performed, whereas in a case where the image capturing flag "1" is stored, the image capturing is being performed. The image capturing flag is stored as an initial value "0".

The CPU 110 performs an image capturing process (S210). As the image capturing process, the CPU 110 sequentially receives partial captured images from the image capturing unit 4, and stores the partial captured images in the partial captured image storage portion 125 of the RAM 120 in order of reception. The partial captured image is an image obtained by capturing each of a plurality of partial regions divided from an image capturing region to be captured. The image sensor controller 41 controls the image sensor 42 to capture the plurality of partial regions sequentially. The image sensor controller 41 controls an image capturing operation of the image sensor 42 so as not to capture the same partial region. The image capturing process is continued until the entire image capturing region is captured by the image capturing unit 4.

The CPU 110 receives a signal indicating an end of the image capturing from the image sensor controller 41, and ends the image capturing (S212). To end the image capturing, the image sensor controller 41 stops power supply to the image sensor 42, and transmits the signal indicating an end of the image capturing to the CPU 110. In response to receiving the signal indicating the end of the image capturing, the CPU 110 sets the image capturing flag stored in the flag storage portion 124 to "0" in S212.

In response to receiving the signal indicating the end of the image capturing, the CPU 110 connects each of the partial captured images stored in the partial captured image storage portion 125 to generate a captured image showing the entire image capturing region (S214). In S214, the CPU 110 stores the generated captured image in the captured image storage portion 122.

The CPU 110 performs a marker detection process (S216). The CPU 110 detects the marker indicating the formation position of the sewing pattern on the sewing workpiece, from the captured image stored in the captured image storage portion 122. The detection of the marker is performed by image processing such as pattern matching. As the marker, for example, Japanese Patent Application Publication No. 2009-172123 discloses a marker that is affixed by a user to a sewing workpiece on which sewing of an embroidery pattern is performed.

The CPU 110 determines whether the marker has been detected from the captured image (S218). In a case where the marker has been detected (S218:YES), the CPU 110 advances the processing to S220. In a case where no marker has been detected (S218:NO), the CPU 110 returns the processing to S208, and performs the series of processing for image capturing again in order to detect the marker.

In a case where the marker has been detected (S218:YES), the CPU 110 changes the projection image based on the detected marker (S220). In the present embodiment, a sewing machine coordinate system, an image capturing coordinate system, and a projection coordinate system are used as coordinate systems. The sewing machine coordinate system is an orthogonal XY coordinate system having an origin at a particular position on the bed 11 and representing a positional coordinate on the bed 11. The image capturing coordinate system is an orthogonal XY coordinate system representing a positional coordinate of the captured image captured by the image capturing unit 4. The projection coordinate system is an orthogonal XY coordinate system representing a positional coordinate of the projection image projected by the projector 3. The positional coordinate in each of the image capturing coordinate system and the projection coordinate system and the positional coordinate in the sewing machine coordinate system are mutually transformable. For example, in a case where the positional coordinate in the image capturing coordinate system is transformed into the positional coordinate in the sewing machine coordinate system, coordinate transformation parameters are determined based on an origin positional coordinate, an inclination of a coordinate axis, and so on in each of the coordinate systems. By a well-known coordinate transformation technique using the determined coordinate transformation parameters, the positional coordinate in the image capturing coordinate system is transformed into the positional coordinate in the sewing machine coordinate system. The CPU 110 detects the positional coordinate of the detected marker in the image capturing coordinate system. After the CPU 110 transforms the positional coordinate in the image capturing coordinate system into the positional coordinate in the sewing machine coordinate system, the CPU 110 transforms the positional coordinate in the sewing machine coordinate system into the positional coordinate in the projection coordinate system. The CPU 110 arranges the sewing pattern in the projection image such that the positional coordinate of the marker in the projection coordinate system is the center of the sewing pattern in the projection image, thereby changing the projection image. The CPU 110 stores the changed projection image in the projection image storage portion 123 of the RAM 120.

The CPU 110 changes the sewing data stored in the sewing data storage portion 121 based on the detected marker (S221). The CPU 110 detects the positional coordinate of the detected marker in the image capturing coordinate system. The CPU 110 transforms the positional coordinate in the image capturing coordinate system into the positional coordinate in the sewing machine coordinate system. The CPU 110 changes the sewing data such that the positional coordinate of the marker in the sewing machine coordinate system is the center of the sewing pattern.

The CPU 110 resumes the projection (S222). The CPU 110 transmits a signal indicating resuming of the projection to the light source controller 31 of the projector 3. In response to receiving the signal indicating resuming of the projection, the light source controller 31 supplies power to the light source 32. By supplying power to the light source 32, light is irradiated from the light source 32, and the projection by the projector 3 is resumed. To resume the projection, the CPU 110 reads out the projection image changed in S220 from the projection image storage portion 123, and transmits the projection image to the liquid crystal controller 33 in S222. After the projection is resumed, the CPU 110 sets the projection flag stored in the flag storage portion 124 to "1" in S222, and ends the scan process.

In a case where the projection is not being performed (S204:NO), the CPU 110 performs processing in S224 to S238. A series of processing in S224 to S238 is processing similar to the series of processing in S208 to S221. After the processing in S238 is performed, the CPU 110 ends the scan process.

In the first embodiment, in the positioning process, when the projection by the projector 3 is being performed and the image capturing unit 4 performs image capturing in response to pressing of the scan key 161 by the user, the CPU 110 interrupts the projection and starts the image capturing. Thus, since the projection is not performed during the image capturing, an influence of the projection image on the captured image is reduced. For example, the marker and the arrangement position of the marker are accurately detected from the captured image without being affected by the projection image, and the sewing pattern is formed at an accurate position on the sewing workpiece based on the arrangement position of the marker.

In the first embodiment, in the positioning process, when the projection by the projector 3 is being performed and the image capturing unit 4 performs image capturing in response to pressing of the scan key 161 by the user, the CPU 110 interrupts the projection and starts the image capturing. Thereafter, when the image capturing is ended, the CPU 110 automatically resumes the projection. Thus, the user is not required to perform an operation for resuming the projection, which saves labor and time of the user.

In the first embodiment, the sewing machine 1 includes the image capturing unit 4 and the projector 3. Thus, the series of processing for image capturing and projection is performed by the sewing machine 1 itself, and the user is not required to prepare another apparatus.

In the first embodiment, when the projection is interrupted in S206, power supply to the light source 32 of the projector 3 is stopped. Thus, irradiation of light is not performed, and an influence of the projection image on the captured image is prevented.

A second embodiment of the present disclosure will be described. The second embodiment differs from the first embodiment in the positioning process of the sewing machine 1. In the second embodiment, the same reference numerals as those in the first embodiment are used for the same components as those in the first embodiment, and the description thereof will be omitted.

Figure 7:
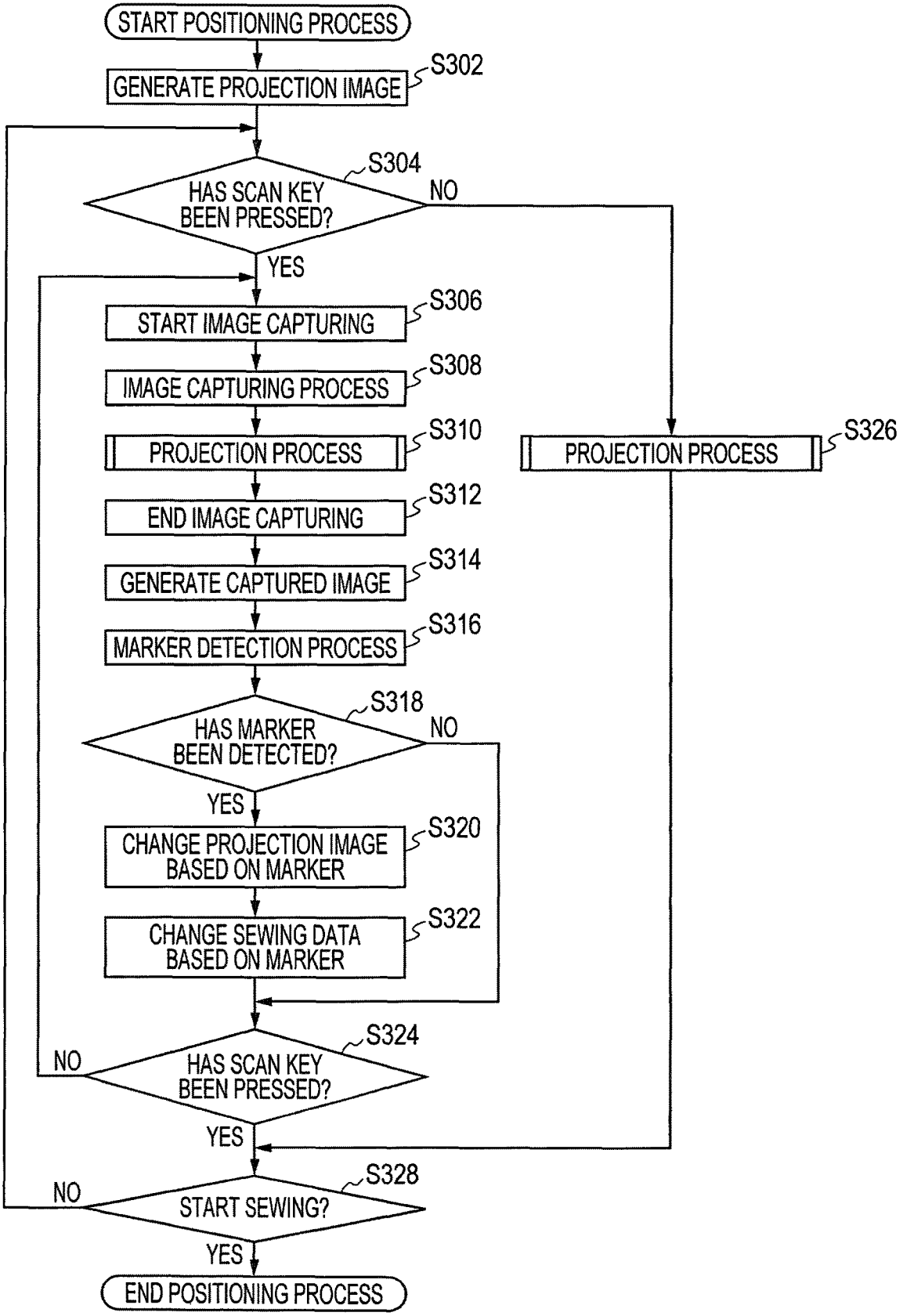
FIG. 7 is a flowchart showing a positioning process of a sewing machine 1.

An operation of a positioning process performed by the sewing machine 1 according to the second embodiment will be described with reference to a flowchart shown in FIG. 7. Each processing of a series of processing in S302 to S328 shown in FIG. 7 is performed by the CPU 110 of the sewing machine 1.

The CPU 110 generates a projection image representing the sewing pattern (S302). The generation of the projection image is performed by processing similar to S102.

In the second embodiment, in a case where the user presses the scan key 161 to cause the image sensor 42 to start the image capturing operation in order to capture the marker affixed to the sewing workpiece, the image capturing operation of the image sensor 42 is repeatedly performed until the user presses the scan key 161 again to cause the image sensor 42 to stop the image capturing operation. While the image capturing operation of the image sensor 42 is repeatedly performed, the user can change the affixing position of the marker without pressing the scan key 161.

The CPU 110 determines whether the scan key 161 has been pressed in order to start the image capturing operation of the image sensor 42 (S304). The determination of whether the scan key 161 has been pressed is performed by processing similar to S202. In a case where the scan key 161 has been pressed (S304:YES), the CPU 110 sets the image capturing flag stored in the flag storage portion 124 to "1" in S304, and then advances the processing to S306. In a case where the scan key 161 has not been pressed (S304:NO), the CPU 110 advances the processing to S326.

In a case where the scan key 161 has been pressed (S304:YES), the CPU 110 starts image capturing (S306). The image capturing is started by processing similar to S208.

The CPU 110 performs an image capturing process (S308). The image capturing process is performed by processing similar to S210.

The CPU 110 performs a projection process (S310). The projection process will be described in detail later.

The CPU 110 ends the image capturing (S312). The image capturing is ended by processing similar to S212.

Processing in S314 to S322 is performed by processing similar to S214 to S221.

The CPU 110 determines whether the scan key 161 has been pressed (S324). The determination of whether the scan key 161 has been pressed is performed by processing similar to S202. In a case where the scan key 161 has been pressed (S324:YES), the CPU 110 sets the image capturing flag stored in the flag storage portion 124 to "0" in S324, and then advances the processing to S328. In a case where the scan key has not been pressed (S324:NO), the CPU 110 returns the processing to S306, and starts the series of processing for image capturing again.

In a case where the scan key 161 has not been pressed (S304:NO), the CPU 110 performs the projection process (S326). After the projection process is performed, the CPU 110 advances the processing to S328.

The CPU 110 determines whether to start sewing (S328). The determination of whether to start sewing is performed by processing similar to S116. In a case where it is determined to start sewing (S328:YES), the CPU 110 ends the positioning process. In a case where it is determined not to start sewing (S328:NO), the CPU 110 returns the processing to S304, and again determines whether the scan key 161 has been pressed.

Figure 8:
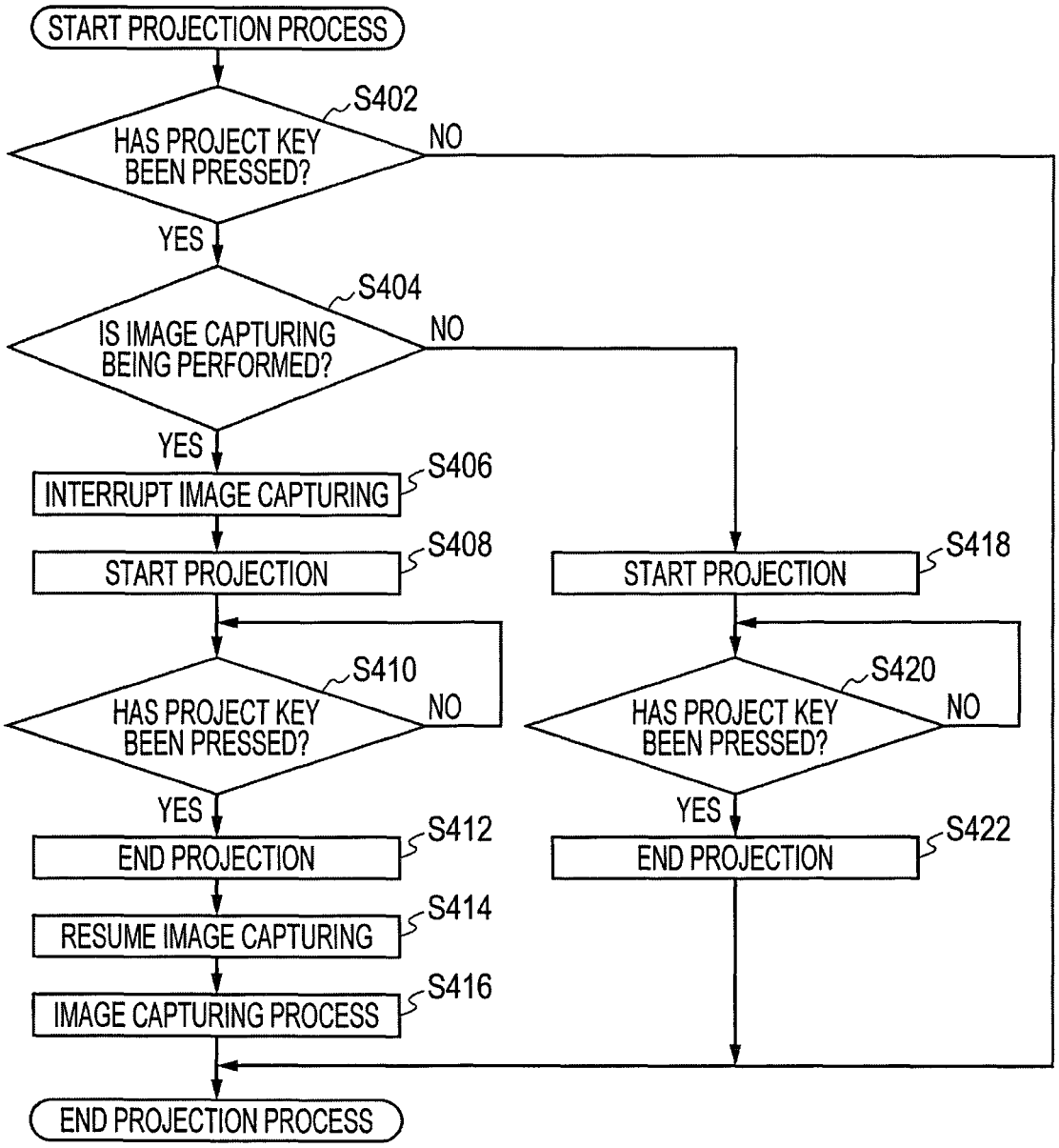
FIG. 8 is a flowchart showing a projection process of the sewing machine 1.

An operation of the projection process performed by the sewing machine 1 according to the second embodiment will be described with reference to a flowchart shown in FIG. 8. A series of processing in S402 to S422 shown in FIG. 8 is performed by the CPU 110 of the sewing machine 1.

The CPU 110 determines whether the project key 162 has been pressed (S402). The determination of whether the project key 162 has been pressed is performed by processing similar to S108. In a case where the project key 162 has been pressed (S402:YES), the CPU 110 advances the processing to S404. In a case where the project key 162 has not been pressed (S402:NO), the CPU 110 ends the projection process.

The CPU 110 determines whether image capturing by the image capturing unit 4 is being performed (S404). The CPU 110 determines whether the image capturing is being performed based on the image capturing flag stored in the flag storage portion 124 of the RAM 120. In a case where the image capturing is being performed (S404:YES), the CPU 110 advances the processing to S406. In a case where the image capturing is not being performed (S404:NO), the CPU 110 advances the processing to S418.

In a case where the image capturing is being performed (S404:YES), the CPU 110 interrupts the image capturing (S406). An image capturing interruption process is performed by, for example, transmitting a signal indicating interruption of the image capturing to the image sensor controller 41 of the image capturing unit 4. In response to receiving the signal indicating interruption of the image capturing, the image sensor controller 41 stops power supply to the image sensor 42. In a case where power supply to the image sensor 42 is stopped, the image capturing by the image capturing unit 4 is interrupted in a partial region where the image capturing is not completed. After the image capturing is interrupted, the CPU 110 sets the image capturing flag stored in the flag storage portion 124 to "0" in S406.

The CPU 110 starts projection (S408). The projection is started by processing similar to S114.

The CPU 110 determines whether the project key 162 has been pressed (S410). The determination of whether the project key 162 has been pressed is performed by processing similar to S108. In a case where the project key 162 has been pressed (S410:YES), the CPU 110 advances the processing to S412. In a case where the project key 162 has not been pressed (S410:NO), the CPU 110 repeats the processing in S410 until the project key 162 is pressed.

The CPU 110 ends the projection (S412). The projection is ended by processing similar to S110.

The CPU 110 resumes the image capturing (S414). The CPU 110 transmits a signal indicating resuming of the image capturing to the image sensor controller 41 of the image capturing unit 4. In response to receiving the signal indicating resuming of the image capturing, the image sensor controller 41 supplies power to the image sensor 42. By supplying power to the image sensor 42, the image capturing by the image capturing unit 4 is resumed. After the image capturing is resumed, the CPU 110 sets the image capturing flag stored in the flag storage portion 124 to "1" in S414.

The CPU 110 performs the image capturing process (S416). The image capturing process is performed by processing similar to S210; however, when the image capturing by the image capturing unit 4 is interrupted in the partial region where the image capturing is not completed, the image capturing process may be resumed from the image capturing process to be performed immediately after the interruption. After the image capturing process is performed, the CPU 110 ends the projection process.

In a case where the image capturing is not being performed (S404:NO), the CPU 110 performs processing in S418 to S422. The processing in S418 to S422 is performed by processing similar to S408 to S412. After the processing in S418 to S422 is performed, the CPU 110 ends the projection process.

In the second embodiment, in the positioning process, when the image capturing by the image capturing unit 4 is being performed and the projection by the projector 3 is performed in response to pressing of the project key 162 by the user, the CPU 110 interrupts the image capturing and starts the projection. Thus, since the image capturing is not performed during the projection, an influence of the projection image on the captured image is reduced.

In the second embodiment, the projection process in S310 is performed by interrupting the image capturing process. Thus, the projection process can be performed even when the image capturing is being performed, and the user can check the projection image without waiting for end of the image capturing. For example, to check arrangement of the sewing pattern formed at the arrangement position of the moved marker, the user can check the arrangement through the projection image.

In the second embodiment, the state where the projection is being performed is maintained until the project key 162 is pressed in S410 or S420. Thus, the user can end the projection at any desired timing and take a time to check the projection image. For example, since the user can determine a projection end timing by pressing the project key 162 in S410, the user can take time to check the arrangement of the sewing pattern through the projection image.

A third embodiment of the present disclosure will be described. The third embodiment differs from the first embodiment in that the image capturing unit 4 and the scan key 161 of the sewing machine 1 of the first embodiment are replaced by an external apparatus 200. The external apparatus 200 is, for example, a smartphone. In the third embodiment, the same reference numerals as those in the first embodiment are used for the same components as those in the first embodiment, and the description thereof will be omitted.

Figure 9:
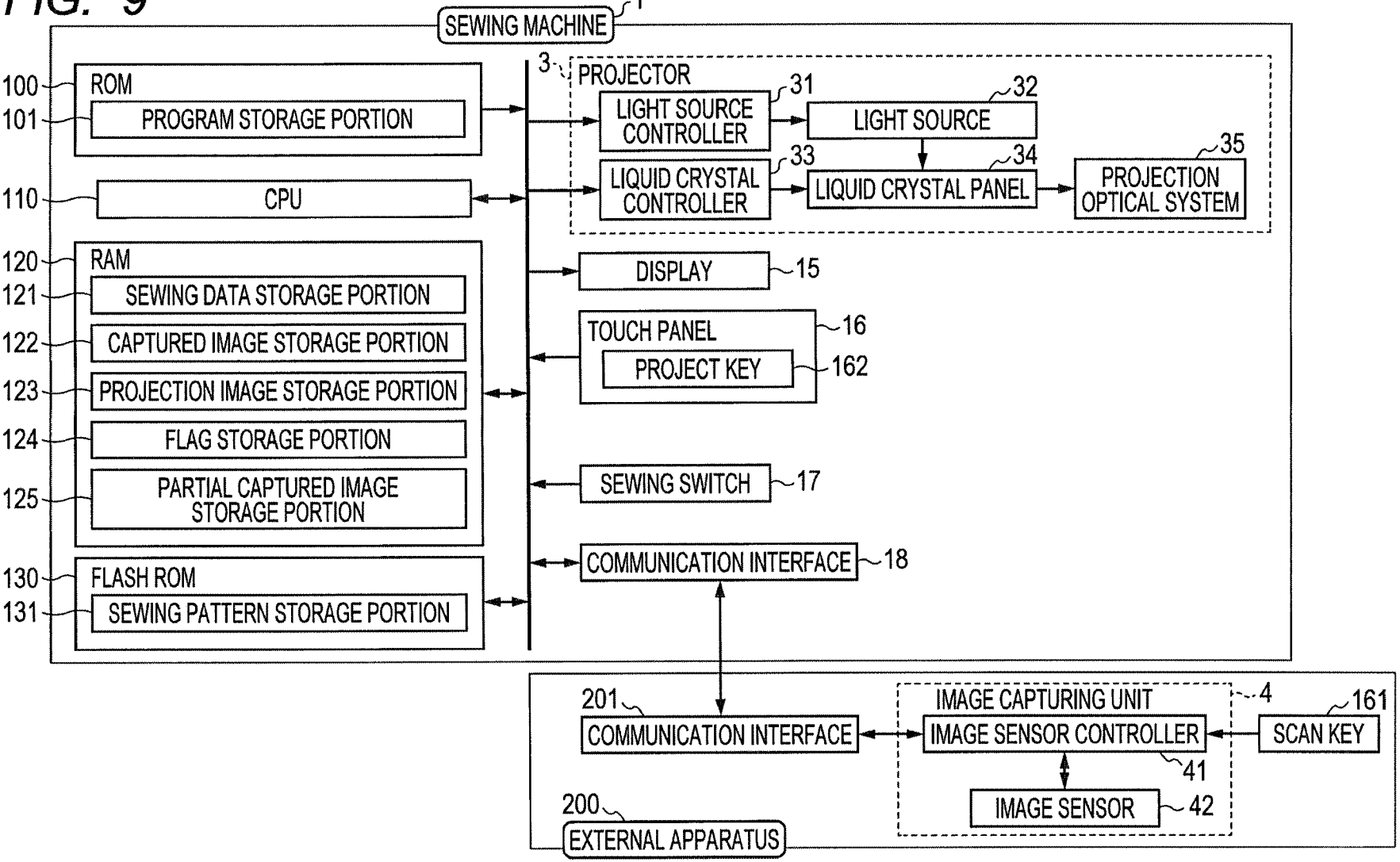
FIG. 9 is a block diagram showing an electrical configuration of a sewing machine 1 and an external apparatus 200.

An electric configuration of the sewing machine 1 of the third embodiment will be described with reference to FIG. 9.

The touch panel 16 includes a function of the project key 162. The user starts or ends projection of the projection image by the projector 3 at a desired timing by operating the project key 162.

The controller of the sewing machine 1 further includes a communication interface 18. The communication interface 18 is an interface for enabling communication between the sewing machine 1 and the external apparatus 200. By connecting the communication interface 18 to a communication interface 201 of the external apparatus 200, information is transmitted and received.

An electric configuration of the external apparatus 200 will be described with reference to FIG. 9.

The external apparatus 200 includes the image capturing unit 4, the communication interface 201, and the scan key 161.

The image capturing unit 4 includes the image sensor controller 41 and the image sensor 42. In a case where the user presses the scan key 161, the image sensor controller 41 receives a signal for starting image capturing from the scan key 161. In response to reception of the signal for starting image capturing, the image sensor controller 41 sequentially captures parts of the image capturing region by the image sensor 42, and continues the image capturing until the entire image capturing region is captured.

The communication interface 201 is an interface for enabling the communication between the sewing machine 1 and the external apparatus 200. When the communication interface 201 is connected to the communication interface 18 of the sewing machine 1, information is transmitted and received.

The user starts image capturing at a desired timing at a position separated from the sewing machine 1 by operating the scan key 161 of the external apparatus 200. In this embodiment, in order to perform positioning based on the position of the marker captured by an external camera (the image capturing unit 4 of the external apparatus 200), correction is performed in accordance with the position and angle of the external camera using a known image processing technique. The result of the positioning is reflected in the projection image. For example, this correction is performed using a known AR technique (a technique of reading a marker in the real space and correcting the image using the position and angle of the camera).

A scan process according to the third embodiment will be described. The scan process according to the third embodiment is performed by processing similar to S204 to S206, S214 to S222, and S230 to S238 of the scan process according to the first embodiment, but is performed by processing different from the processing in S202, S208 to S212, and S224 to S228. In the following, the different processing will be described.

The CPU 110 determines whether the scan key 161 of the external apparatus 200 has been pressed (S202). The scan key 161 is provided on the external apparatus 200. When the user presses the scan key 161 by a finger and so on, the CPU 110 receives a signal indicating pressing of the scan key 161 from the external apparatus 200, and determines that the scan key 161 has been pressed (S202: YES). The signal indicating pressing of the scan key 161 is received by the CPU 110 through the communication interface 201 and the communication interface 18.

The CPU 110 transmits a signal indicating start of image capturing to the image sensor controller 41 of the image capturing unit 4 of the external apparatus 200, and starts image capturing (S208). The signal indicating start of image capturing is transmitted to the image sensor controller 41 of the external apparatus 200 through the communication interface 18 and the communication interface 201.

The CPU 110 performs an image capturing process (S210). As the image capturing process, the CPU 110 sequentially receives partial captured images from the image capturing unit 4 of the external apparatus 200, and stores the partial captured images in the partial captured image storage portion 125 of the RAM 120. The partial captured images are sequentially transmitted from the image capturing unit 4 of the external apparatus 200 through the communication interface 201 and the communication interface 18. The image capturing process is continued until the entire image capturing region is captured by the image capturing unit 4.

The CPU 110 receives a signal indicating an end of the image capturing from the external apparatus 200, and ends the image capturing (S212). The signal indicating the end of the image capturing is transmitted from the image sensor controller 41 of the external apparatus 200 to the CPU 110 through the communication interface 18 and the communication interface 201. In response to receiving the signal indicating the end of the image capturing, the CPU 110 sets the image capturing flag stored in the flag storage portion 124 to "0" in S212. To end the image capturing, the image sensor controller 41 of the external apparatus 200 performs an image capturing end process of the image sensor 42, such as stopping power supply to the image sensor 42.

The processing from S224 to S228 is performed by the same processing as that from S208 to S212.

In the third embodiment, the external apparatus 200 includes the image capturing unit 4. Thus, even in the sewing machine 1 in which the image capturing unit 4 is not provided, the functions of the present disclosure are performed by communicating with the external apparatus 200 that includes the image capturing unit 4.

According to the control device for the sewing machine of one aspect, when one of the image capturing control state and the projection control state is in the execution state and the other control state changes from the non-execution state to the execution state, the one control state changes from the execution state to the non-execution state. Thus, the projection and the image capturing are not performed at the same time, the influence of the projection image on the captured image is reduced, and the control device for the sewing machine accurately controls the sewing.

According to the control device for the sewing machine of one aspect, the user can arbitrarily change the image capturing control state the by operating the image capturing operation interface, and the projection control state by operating the projection operation interface. However, it is necessary for the user to perform an operation so that the projection and the image capturing are not performed at the same time. Thus, when one of the image capturing control state and the projection control state is in the execution state and the other of the image capturing control state and the projection control state is changed from the non-execution state to the execution state, the control device for the sewing machine automatically changes one of the image capturing control state and the projection control state from the execution state to the non-execution state, thereby reducing the time and effort of the user's operation.

According to the control device for the sewing machine of one aspect, in a case where, after one of the image capturing control state and the projection control state is changed from the execution state to the non-execution state, the other control state changes from the execution state to the non-execution state, the one control state is changed from the non-execution state to the execution state. Thus, since the control device for the sewing machine automatically returns one control state to the execution state, the user smoothly resumes the work related to the sewing when one control state was in the execution state.

According to the control device for the sewing machine of one aspect, in a case where the image capturing unit performs image capturing, if the projector is performing projection, projection is interrupted and image capturing is performed. Thus, by giving priority to the image capturing of the image capturing unit, the influence of the projection image on the captured image is reduced.

According to the control device for the sewing machine of one aspect, in a case where image capturing by the image capturing unit is finished after projection is interrupted, projection is automatically resumed. Thus, the projection is smoothly resumed, which allows the user to check the projection image in which the result of the image capturing is reflected.

According to the control device for the sewing machine of one aspect, in a case where the projection control state changes to the non-execution state, the supply of power to the light source of the projector is stopped. Thus, when the projection control state is in the non-execution state, the light is not irradiated from the projector, and the influence of the projection image on the captured image is prevented.

According to the control device for the sewing machine of one aspect, in a case where the projection control state changes to the execution state, a projection image represented by a plurality of colors is projected, and in a case where the projection control state changes to the non-execution state, a single color image represented by a single color is projected instead of the projection image of the plurality of colors. Thus, since the light source of the projector maintains the irradiation state, an operation of changing the state of the projection control state is performed more quickly than switching between supply and stop of power to the light source.

According to the control device for the sewing machine of one aspect, in a case where the projection control state changes to the non-execution state, a single color image represented by black color is projected instead of a projection image of a plurality of colors. Thus, while maintaining the state in which the light source of the projector emits light, the influence of the projection image on the captured image is reduced.

According to the control device for the sewing machine of one aspect, in a case where the image capturing control state changes to the non-execution state, the supply of power to the image capturing unit is stopped. Thus, as compared with a configuration in which a controller for image capturing inputs and processes a captured image, the image capturing control state is easily and reliably changed to the non-execution state.

According to the control device for the sewing machine of one aspect, the marker indicating the formation position of the sewing pattern on the sewing workpiece in the captured image that is acquired by performing image capturing is detected. While image capturing is being performed to detect the marker, projection is interrupted to reduce the influence of the projection image on the captured image. Thus, the control device for the sewing machine accurately detects the marker, and accurately determines the formation position of the sewing pattern on the sewing workpiece.

The sewing machine 1 shown in FIG. 1 is an example of a sewing machine of the present disclosure. The ROM 100, the CPU 110, the RAM 120 and the flash ROM 130 shown in FIG. 3 are an example of a sewing machine controller of the present disclosure. The bed 11 shown in FIG. 1 is an example of a bed of the present disclosure. The image capturing unit 4 shown in FIGS. 2, 3, and 9 is an example of an image capturing unit 4 of the present disclosure. The projector 3 shown in FIGS. 2 and 3 is an example of a projector of the present disclosure. The processing of S224 and S228 shown in FIG. 6 and the processing of S306 and S312 shown in FIG. 7 are examples of an image capturing controller of the present disclosure. The processing of S110, S114, and S120 shown in FIG. 5 and the processing of S418 and S422 shown in FIG. 8 are an example of a projection controller of the present disclosure. The series of processes from S204 to S208 shown in FIG. 6 and the series of processes from S404 to S408 shown in FIG. 8 are an example of an interlocking operation of the present disclosure. The scan key 161 shown in FIGS. 3 and 9 is an example of an image capturing operation interface of the present disclosure. The project key 162 shown in FIGS. 3 and 9 is an example of a projection operation interface of the present disclosure. The light source 32 shown in FIGS. 3 and 9 is an example of a light source of the present disclosure. The projection image storage portion 123 shown in FIGS. 3 and 9 is an example of an image storage portion of the present disclosure. The CPU 110 shown in FIGS. 3 and 9 is an example of an image acquisition means of the present disclosure. The processing from S208 to S214 and the processing from S224 to S230 shown in FIG. 6, and the processing from S306 to S308 and the processing from S312 to S314 shown in FIG. 8 are examples of a captured image acquisition operation of the present disclosure. The processing of S216 and the processing of S232 shown in FIG. 6 and the processing of S316 shown in FIG. 8 are examples of a marker detection operation of the present disclosure. The external apparatus 200 shown in FIG. 9 is an example of an external apparatus of the present disclosure. The positioning process shown in FIG. 5, the scan process shown in FIG. 6, the positioning process shown in FIG. 7, and the projection process shown in FIG. 8 are examples of a sewing machine control program of the present disclosure. For example, a state in which image capturing is started in S208 of FIG. 6 is an example of a capture execution state of the present disclosure, and a state in which image capturing is ended in S212 in FIG. 6 is an example of a capture non-execution state of the present disclosure. For example, a state in which projection is interrupted in S206 of FIG. 6 is an example of a projection non-execution state of the present disclosure, and a state in which projection is resumed in S222 in FIG. 6 is an example of a projection execution state of the present disclosure.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

(1) In the present embodiment, the sewing machine controller is included inside the sewing machine 1, but the present disclosure is not limited to this configuration. For example, the sewing machine controller may be included in an information processing apparatus such as an external personal computer and a smartphone connected to the sewing machine 1.

(2) In the present embodiment, the projection region and the image capturing region share a part of each region on the bed 11, but the present disclosure is not limited to this configuration. For example, if the projection of the projection image affects the captured image, a configuration may be employed in which the image capturing region and the projection region do not share a part of each region and are close to each other.

(3) In the present embodiment, when the projection is interrupted in S206, the supply of power to the light source 32 is stopped, but the present disclosure is not limited to this configuration. For example, in a case where a black plain image is projected, the image is recognized by the user and the image capturing unit 4 in the same manner as a state in which the image is not projected. The black plain image is filled with black color. All pixels in the black plain image are black color. Specifically, more than 90% of pixels in the black plain image are black color. The CPU 110 generates and acquires a black plain image. The CPU 110 may be configured to interrupt the projection of the projection image by projecting the generated black plain image. In this configuration, an influence of the projection image on the captured image is reduced while maintaining a state in which the light source 32 emits light. The image is not limited to a black plain image, and any plain image may be used as long as the color does not affect the captured image, such as dark gray. The image is not limited to a black plain image, and may be a multi-color image of colors that do not affect the captured image, such as a multi-color image of black and gray.

For example, the projection may be interrupted by setting the transmittance of each liquid crystal element of the liquid crystal panel 34 to the minimum. The CPU 110 transmits a signal indicating interruption of the projection to the liquid crystal controller 33. In response to receiving the signal indicating the interruption of the projection, the liquid crystal controller 33 sets the transmittance of each liquid crystal element of the liquid crystal panel 34 to the minimum. By setting the transmittance of each liquid crystal element of the liquid crystal panel 34 to the minimum, the light from the light source 32 is not transmitted, and the projection is interrupted.

For example, the projection may be interrupted by controlling the amount of light from the light source 32. The light source controller 31 performs control to reduce the amount of light from the light source 32 to a value that does not affect the captured image, whereby the projection is interrupted.

For example, a configuration may be adopted in which an illumination unit (lighting unit) that illuminates the top of the bed 11 is provided on the sewing machine 1, and the projection is interrupted by controlling the light amount of the illumination unit. The CPU 110 performs control to increase or decrease the light amount of the illumination unit to a value that does not affect the captured image, whereby the projection is interrupted.

(4) In the first embodiment, in the processing from S206 to S208, the projection is interrupted before the image capturing is started. However, the present disclosure is not limited to this configuration. For example, the projection may be interrupted at the same time when the image capturing is started. Alternatively, the interruption of the projection may be performed after the image capturing is started within a range in which the captured image is not affected.

(5) In the first embodiment, in S222, the projection is automatically resumed when the image capturing ends. However, the present disclosure is not limited to this configuration. For example, the projection may not be resumed until the scan key 161 is pressed again.

(6) In the present embodiment, in the image capturing process of the S210 and so on, the CPU 110 sequentially receives the partial captured images and stores the partial captured images in the partial captured image storage portion 125. However, the present disclosure is not limited to this configuration. For example, after the image capturing unit 4 finishes image capturing of the entire image capturing region, the CPU 110 may collectively receive the partial captured images. Further, the CPU 110 may be configured to receive a plurality of partial captured images in several batches.

(7) In the present embodiment, a configuration is adopted in which the captured image is generated from the partial captured images in the captured image generation process of S214 and so on, but the present disclosure is not limited to this configuration. For example, after the captured image is generated by the image sensor controller 41, the CPU 110 may receive the captured image. In this configuration, the partial captured image storage portion 125 is provided in the image capturing unit 4. Alternatively, the image sensor 42 may be configured to capture an image of the entire image capturing region in one image capturing operation. In this configuration, the CPU 110 receives the captured image and stores the captured image in the captured image storage portion 122 as it is.

(8) In the second embodiment, the supply of power to the image sensor 42 is stopped in S406, but the present disclosure is not limited to this configuration. For example, the CPU 110 may be configured to interrupt image capturing by not performing reception of a partial captured image.

(9) In the second embodiment, in the processing from S406 to S408, the image capturing is interrupted before the projection is started. However, the present disclosure is not limited to this configuration. For example, the image capturing may be interrupted at the same time as the projection is started. Alternatively, the image capturing may be interrupted after the projection is started within a range in which the captured image is not affected.

(10) The external apparatus 200 in the third embodiment may be an apparatus including an image capturing unit such as a camera or a PC, for example, instead of a smartphone.

(11) In the present embodiment, the scan key 161 and the project key 162 are set in a particular area on the touch panel 16, but the present disclosure is not limited to this configuration. For example, similarly to the sewing switch 17, the scan key 161 and the project key 162 may be provided on a main body of the sewing machine 1.

(12) In the present embodiment, the image sensor 42 captures an image of the marker affixed to the position on the sewing workpiece that corresponds to the formation position of the sewing pattern, but the present disclosure is not limited to this configuration. For example, as disclosed in Japanese Patent Application Publication No. 2009-297190 (corresponding to U.S. Patent Application Publication No. 2009/0312861) and so on, in order to form buttonhole stitches, the image sensor may capture an image of a button disposed on the needle plate of the sewing machine, and the diameter of the button may be calculated from the captured image. Further, as disclosed in Japanese Patent Application Publication No. 2012-45019 (corresponding to U.S. Patent Application Publication No. 2012/0048163) and so on, the image sensor may capture an image of a plurality of markers arranged on a buttonhole stitch presser foot (buttonhole foot), and the feed amount of the sewing workpiece may be calculated from the captured image. In these configurations related to the formation of the buttonhole stitches, the projector may project a projection image representing a pattern of the buttonball stitches or a projection image representing a captured button, toward the bed including the needle plate.

What is claimed is:

1. A control device for a sewing machine including a bed, an image sensor configured to capture an image on the bed, and a projector configured to project a projection image toward the bed, the control device comprising:

a controller configured to:

change a capture control state of the image sensor between a capture execution state of controlling the image sensor to perform image capturing and a capture non-execution state of controlling the image sensor to not perform image capturing;

change a projection control state of the projector between a projection execution state of controlling the projector to perform projection of the projection image and a projection non-execution state of controlling the projector to not perform projection of the projection image, the projection image representing a sewing pattern; and in a case where the projection control state is in the projection execution state and the capture control state changes from the capture non-execution state to the capture execution state, change the projection control state from the projection execution state to the projection non-execution state.

2. The control device according to claim 1, wherein the sewing machine includes an image capturing operation interface and a projection operation interface; and wherein the controller is configured to:

in response to an operation to the image capturing operation interface, change the capture control state from the capture non-execution state to the capture execution state;

in response to an operation to the projection operation interface, change the projection control state between the projection execution state and the projection non-execution state; and in a case where the projection control state is in the projection execution state and the capture control state changes from the capture non-execution state to the capture execution state due to an operation to the image capturing operation interface, change the projection control state from the projection execution state to the projection non-execution state.

3. The control device according to claim 1, wherein the controller is configured to:

in a case where the projection control state is in the projection non-execution state and the capture control state changes from the capture execution state to the capture non-execution state, change the projection control state from the projection non-execution state to the projection execution state.

4. The control device according to claim 1, wherein the projector includes a light source configured to emit light;

wherein the projection execution state is a state in which electric power is supplied to the light source; and wherein the projection non-execution state is a state in which supply of electric power to the light source is stopped.

5. The control device according to claim 1, further comprising a memory configured to store the projection image represented by a plurality of colors, wherein the controller is configured to acquire a plain image filled with a single color;

wherein the projection execution state is a state in which the projection image stored in the memory is projected; and wherein the projection non-execution state is a state in which the plain image acquired by the controller is projected.

6. The control device according to claim 5, wherein the single color is black color.

7. The control device according to claim 1, wherein the capture execution state is a state in which electric power is supplied to the image sensor; and wherein the capture non-execution state is a state in which supply of electric power to the image sensor is stopped.

8. The control device according to claim 1, wherein the projection image represents a sewing pattern that is a pattern of stitches formed on a sewing workpiece, the projector including a light source configured to emit light;

wherein the capture execution state is a state in which electric power is supplied to the image sensor and image capturing is performed;

wherein the capture non-execution state is a state in which supply of electric power to the image sensor is stopped and image capturing is not performed;

wherein the projection execution state is a state in which electric power is supplied to the light source;

wherein the projection non-execution state is a state in which supply of electric power to the light source is stopped; and wherein the controller is configured to:

in a case where the capture control state is in the capture execution state, acquire a captured image by capturing the image on the bed with the image sensor;

detect a marker indicating a position where the sewing pattern is to be formed on the sewing workpiece in the image captured by the image sensor;

in a case where the projection control state is in the projection execution state and the capture control state changes from the capture non-execution state to the capture execution state, change the projection control state from the projection execution state to the projection non-execution state; and in a case where the capture control state changes from the capture execution state to the capture non-execution state after the marker is detected, change the projection control state from the projection non-execution state to the projection execution state.

9. The control device according to claim 1, wherein the projector includes:

a light source configured to emit light; and a liquid crystal panel including a plurality of liquid crystal elements; and wherein the projection non-execution state is a state in which a transmittance of each of the plurality of liquid crystal elements is set to minimum.

10. The control device according to claim 1, wherein the projector includes a light source configured to emit light; and wherein the projection non-execution state is a state in which an amount of light from the light source is reduced to a value that does not affect the image captured by the image sensor.

11. The control device according to claim 1, wherein the controller is configured to:

in a case where the capture control state is in the capture execution state and the projection control state changes from the projection non-execution state to the projection execution state, change the capture control state from the capture execution state to the capture non-execution state.

12. A control device for a sewing machine including a bed, an image sensor configured to capture an image on the bed, and a projector configured to project a projection image toward the bed, the control device comprising:

a controller configured to:

change a capture control state of the image sensor between a capture execution state of controlling the image sensor to perform image capturing and a capture non-execution state of controlling the image sensor to not perform image capturing;

change a projection control state of the projector between a projection execution state of controlling the projector to perform projection of the projection image and a projection non-execution state of controlling the projector to not perform projection of the projection image; and in a case where the capture control state is in the capture execution state and the projection control state changes from the projection non-execution state to the projection execution state, change the capture control state from the capture execution state to the capture non-execution state.

13. A sewing machine comprising:

a bed;

an image sensor configured to capture an image on the bed;

a projector configured to project a projection image toward the bed; and a controller configured to:

change a capture control state of the image sensor between a capture execution state of controlling the image sensor to perform image capturing and a capture non-execution state of controlling the image sensor to not perform image capturing;

change a projection control state of the projector between a projection execution state of controlling the projector to perform projection of the projection image and a projection non-execution state of controlling the projector to not perform projection of the projection image, the projection image representing a sewing pattern; and in a case where the projection control state is in the projection execution state and the capture control state changes from the capture non-execution state to the capture execution state, change the projection control state from the projection execution state to the projection non-execution state.

14. The sewing machine according to claim 13, further comprising an image capturing operation interface and a projection operation interface; and wherein the controller is configured to:

in response to an operation to the image capturing operation interface, change the capture control state from the capture non-execution state to the capture execution state;

in response to an operation to the projection operation interface, change the projection control state between the projection execution state and the projection non-execution state; and in a case where the projection control state is in the projection execution state and the capture control state changes from the capture non-execution state to the capture execution state due to an operation to the image capturing operation interface, change the projection control state from the projection execution state to the projection non-execution state.

15. The sewing machine according to claim 13, wherein the controller is configured to:

in a case where the projection control state is in the projection non-execution state and the capture control state changes from the capture execution state to the capture non-execution state, change the projection control state from the projection non-execution state to the projection execution state.

16. The sewing machine according to claim 13, wherein the projector includes a light source configured to emit light;

wherein the projection execution state is a state in which electric power is supplied to the light source; and wherein the projection non-execution state is a state in which supply of electric power to the light source is stopped.

17. The sewing machine according to claim 13, further comprising a memory configured to store the projection image represented by a plurality of colors, wherein the controller is configured to acquire a plain image filled with a single color;

wherein the projection execution state is a state in which the projection image stored in the memory is projected; and wherein the projection non-execution state is a state in which the plain image acquired by the controller is projected.

18. The sewing machine according to claim 13, wherein the capture execution state is a state in which electric power is supplied to the image sensor; and wherein the capture non-execution state is a state in which supply of electric power to the image sensor is stopped.

19. The sewing machine according to claim 13, wherein the projection image represents a sewing pattern that is a pattern of stitches formed on a sewing workpiece, the projector including a light source configured to emit light;

wherein the capture execution state is a state in which electric power is supplied to the image sensor and image capturing is performed;

wherein the capture non-execution state is a state in which supply of electric power to the image sensor is stopped and image capturing is not performed;

wherein the projection execution state is a state in which electric power is supplied to the light source;

wherein the projection non-execution state is a state in which supply of electric power to the light source is stopped; and wherein the controller is configured to:

in a case where the capture control state is in the capture execution state, acquire a captured image by capturing the image on the bed with the image sensor;

detect a marker indicating a position where the sewing pattern is to be formed on the sewing workpiece in the image captured by the image sensor;

in a case where the projection control state is in the projection execution state and the capture control state changes from the capture non-execution state to the capture execution state, change the projection control state from the projection execution state to the projection non-execution state; and in a case where the capture control state changes from the capture execution state to the capture non-execution state after the marker is detected, change the projection control state from the projection non-execution state to the projection execution state.

20. The sewing machine according to claim 13, wherein the controller is configured to:

in a case where the capture control state is in the capture execution state and the projection control state changes from the projection non-execution state to the projection execution state, change the capture control state from the capture execution state to the capture non-execution state.

* * * * *